United States Patent [19]

Ritzenthaler et al.

[11] 4,381,431

[45] Apr. 26, 1983

[54] HAND SET TIMER

[75] Inventors: Donald R. Ritzenthaler, Reedsburgh; Thomas J. Bottelson, Baraboo, both of Wis.

[73] Assignee: Gulf & Western Manufacturing Company, Southfield, Mich.

[21] Appl. No.: 257,258

[22] Filed: Apr. 24, 1981

[51] Int. Cl.[3] ..... H01H 43/10; H01H 9/00

[52] U.S. Cl. ..... 200/38 R; 200/293

[58] Field of Search ..... 368/108; 200/38 R, 38 B, 200/38 BA, 38 C, 38 CA, 39 R, 245–247, 283, 293, 303

[56] References Cited

U.S. PATENT DOCUMENTS

| | | | |
|---|---|---|---|
| 3,568,429 | 3/1971 | DeLille | 368/108 |
| 3,578,923 | 5/1971 | Morey et al. | 200/38 R X |
| 3,678,225 | 7/1972 | Hultenstrum | 200/38 CA X |
| 3,699,277 | 10/1972 | Straub | 200/38 B X |
| 3,699,278 | 10/1972 | Jones et al. | 200/38 B X |
| 3,700,838 | 10/1972 | Brown et al. | 200/38 B X |
| 3,742,159 | 6/1973 | Brown | 200/38 B X |

*Primary Examiner*—J. R. Scott

*Attorney, Agent, or Firm*—Body, Vickers & Daniels

[57] ABSTRACT

In a hand set timer of the type including a housing, a constant speed motor mounted on the housing, a switch actuating element in the housing and driven by the motor through a drive shaft between a manually set position and a switch actuated position, and a manual means, such as a knob, for moving the switch actuating element independently of the motor from the switch actuated position to the manually set position, there is provided an improvement wherein the housing is formed from two separate components which are held together by a locking means carried on the motor so that assembly of the motor onto the housing performs the function of locking the two housing components together. In addition, the improved hand set timer includes a switch formed from two or three contacts mounted in the housing itself so that the contacts can be moved into an operative position by the switch actuating element movable by the motor within the housing.

21 Claims, 12 Drawing Figures

HAND SET TIMER

The present invention relates to the art of mechanical timers and more particularly to a mechanical hand set timer.

BACKGROUND OF INVENTION

Mechanical timers used in domestic applicances and on certain industrial equipment must be low cost devices. Mechanical hand set timers have been developed for this market. Such a timer is shown in U.S. Pat. No. 3,568,429, wherein a motor is mounted on a housing to drive a cam that actuates a standard, purchased switch when the position of the cam indicates expiration of certain time. A knob moves the cam into a set time position which energizes the motor and causes the motor to drive the cam until the switch actuated position is reached. At that time, the switch is actuated and the motor is de-energized. When the cycle is concluded, the external circuit being controlled is either activated or de-activated in accordance with the function of the timer switch in the circuit. For background purposes, the prior U.S. patent is incorporated by reference herein.

The primary requirements of a mechanical hand set timer of the type to which the present invention is directed is low cost and dependable operation. Three of the primary cost factors in mass production of the hand set timers are the cost of assembly, the need for separate, purchased switches and the need for an arrangement to change the switching functions of the timer to produce a normally closed, normally opened, and/or double throw switching function. A substantial amount of effort has been devoted to reduce the cost of these three items in mechanical hand set timers for commercial application.

INVENTION

The present invention relates to a hand set timer of the type described above and as generally shown in prior U.S. Pat. No. 3,568,429. This new hand set timer is constructed in a manner to reduce the manufacturing costs by reducing assembly expenses, avoiding costly purchased switch units and simplifying the changing of the timer for various switch operations.

In accordance with the present invention there is provided an improvement in a hand set switch, of the type defined above, which improvement includes forming the housing of the hand set timer from a first component adjacent the manual knob, a second component adjacent the motor and a locking means affixed to the motor for locking the two components together at the housing end adjacent the motor. In this manner, assembly of the motor locks the housing components together.

In accordance with another aspect of the invention, there is provided a hand set timer of the general type described above, which timer is provided with a switch formed by contacts having two relative contact states, with at least one of the contacts being supported on an elongated electrically conductive strip. The housing itself supports this strip in a cantilever fashion.

By incorporating the features of the present invention into a timer, the timer may be assembled by snapping the motor onto the housing. In addition, the switch means is formed from two or more conductive strips mounted on the housing itself. Separate, purchased switches are not needed. The arrangement of the contacts can be changed to produce different types of output switching functions for the timer. Consequently, a hand set timer constructed in accordance with the present invention is relatively inexpensive and satisfies various commercial needs.

The primary object of the present invention is the provision of a mechanical hand set timer, which timer is less expensive and easier to assemble than previous hand set timers.

Yet another object of the present invention is the provision of a hand set timer, which timer can be assembled by merely placing the motor onto the housing. The motor has structural elements that hold the housing together so that additional fasteners and assembly elements are not required.

Still a further object of the present invention is the provision of a hand set timer of the type described above, which timer includes individually mounted contact strips held by the housing itself. The strips form a switching means within the housing and also the terminals extending outside the housing. In this manner, selective mounting of the contact strips within the housing can produce various switching functions for the timer.

Yet another object of the present invention is the provision of a hand set timer of the type described above, which timer does not require purchased, commercially available switch units.

These and other objects and advantages will become apparent from the following description taken together with the accompanying drawings.

BRIEF DESCRIPTION OF DRAWINGS

Referring now to the drawings wherein the showings are for the purpose of illustrating a preferred embodiment of the invention only, and not for the purpose of limiting same, FIGS. 1-4 show a hand set timer A having a housing B and operated by a motor C secured to the rear of housing B. An appropriate dial D at the opposite end of housing B is provided with timing indicia that indicates the angular set position of knob E having an outwardly extending pointer 10. In accordance with standard practice, knob E is rotated counter-clockwise to the desired time setting. In a manner common in the art, this set position activates the circuit of synchronous motor C. Upon receipt of a starting command, motor C rotates at a constant speed to drive timer A until internal switches are actuated. Then motor C is de-energized. This time interval or cycle is indicated by the angular displacement of pointer 10 with respect to dial D. The switch actuating means, as in various hand set and reset timers, is a cam 20. This cam can have a variety of structural features; however in accordance with the illustrated embodiment of the invention, cam 20 includes integral hub 22 and diametrically spaced clearance recesses 24, 26 with the former recess having a larger radial length than the latter recess. A central bore 30, through cam 20, is used to mount cam 20 in a manner that it may be rotated by motor C in a first direction from the hand set position to the switch actuated position and can be moved in an opposite direction by knob E. In the illustrated embodiment of the invention, the switch actuated position is determined by the location of a recess 32 in the outer surface of cam 20, which recess can be generally referred to as a lobe; however, the recess is formed as an indentation as opposed to a projection. When recess or lobe 32, which has an inwardly narrowing dimension, is in the switch actuated position, shown in FIG. 5B, motor C is de-energized and the switch or switches within timer A are actuated. This feature will be explained in more detail later.

Figure 4:
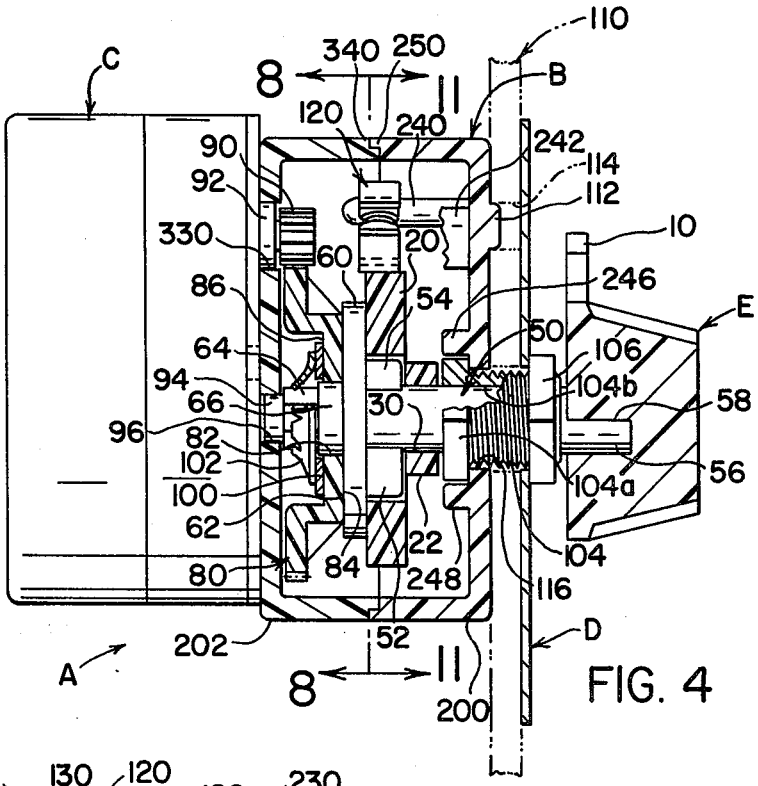
FIG. 4 is a partially cross-sectioned, side elevational view showing the preferred embodiment of the present invention.

Cam 20 is driven by motor C by a rotatably mounted shaft 50 having diametrically spaced protrusions 52, 54 which are loosely received within recesses 24, 26, respectively. This loose connection between cam 20 and shaft 50 allows the protrusion 132 on spring strip 124 to push to cam 20 ahead when cam 20 is adjacent to the switch actuated position. Shaft 50 terminates in a knob receiving nose 56 defined by a generally flat portion 58, which portion extends into an appropriate recess of knob E, as shown in FIG. 4. The flat portion aligns the knob with the angular position of shaft 50 and allows rotation of the shaft by rotation of the knob. Formed integrally with shaft 50 is a collar 60 having a rearwardly facing friction surface 62. In a manner to be described later, this friction surface forms a friction clutch, which allows shaft 50 to be rotated by motor C while not inhibiting the ability of shaft 50 to be rotated in the opposite direction by knob E. A lock stud 64 is integrally formed with shaft 50 behind a circumferentially extending integrally formed journal surface 66. Shaft 50 is formed from plastic material, such as acetal. In a like manner, integrally formed cam 20 is plastic and preferably formed from acetal.

Figure 3:
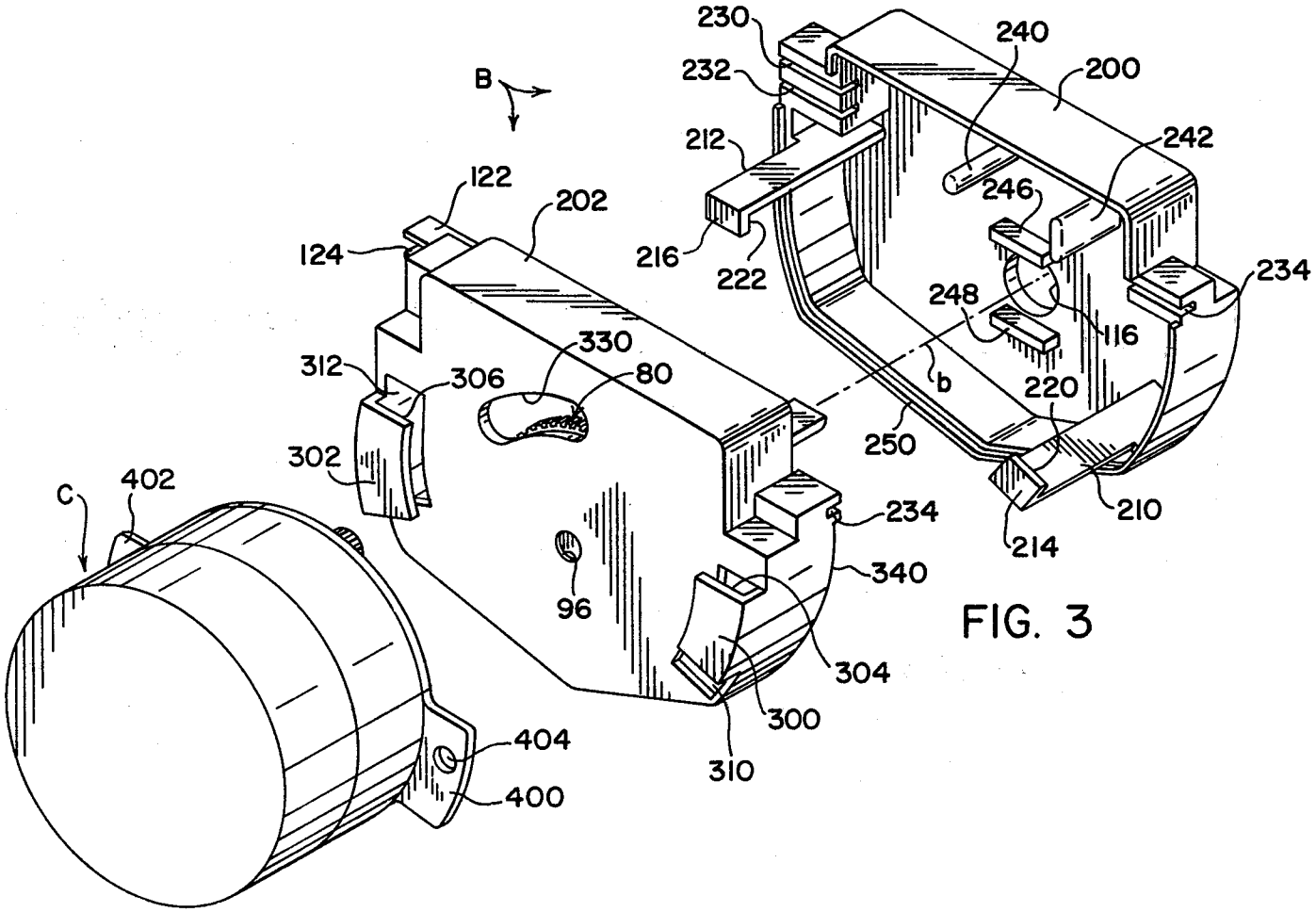
FIG. 3 is an exploded view pictorially showing basic components of the housing and motor employed in the assembly feature of the present invention.

To drive the shaft 50 from the hand set position to the switch actuated position, in accordance with the illustrated embodiment, there is provided a plastic gear 80 having an inner bearing surface 82 rotatably received upon journal surface 66 of shaft 50. Generally flat friction surface 84 of gear 80 abuts friction surface 62 of collar 60 formed integrally with shaft 50. Gear 80 is biased against collar 60 so that surface 84 engages friction surface 62. This biasing action takes place by applying a continuous force at surface or shoulder 86 on gear 80, as shown in FIG. 4. In this manner, pinion gear 90, driven by motor C, engages gear 80 to drive the gear 80 in the normal clockwise direction as viewed from the front of timer A. The driving action between gear 80 and shaft 50 is through engagement of surfaces 62, 84. Pinion gear 90 extends from motor C at a support boss 92, which boss is stationary and extends into housing B. To assemble the various components so far described, shaft 50 includes an end 94 which extends into journal opening 96 of housing B, as best shown in FIGS. 3 and 4. A thrust washer 100 is placed around surface 66 and a spring push nut 102, of the standard gripping type, is secured over lock stud 64 so that the nut clamps gear 80 between washer 100 and collar 60.

Figure 5A:
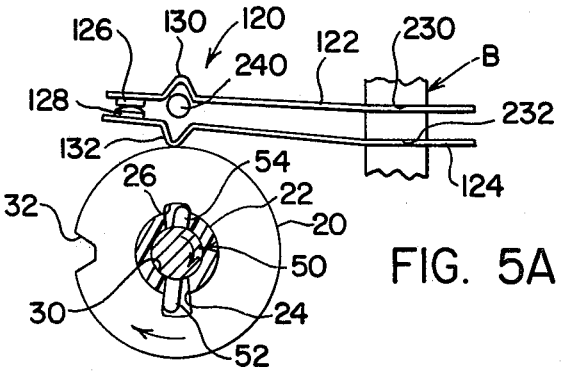
FIG. 5A and 5B are schematic views illustrating the contact strips and cam switch actuator as used in the illustrated embodiment of the invention.

During normal operation of timer A, pinion gear 90 drives gear 80 which is coupled by friction to collar 60 to drive shaft 50. To set the timer A, knob E is moved in a counter-clockwise direction and pinion gear 90 holds driving gear 80 in a generally fixed angular position. Thus, collar 60 can be moved with respect to gear 80 to set the timer for a subsequent timing cycle. Thereafter, motor C is energized to drive shaft 50 to the switch actuated position through an angle determined by the manual seting of pointer 10. Of course, other arrangements could be used for allowing setting of timer A by moving cam lobe portion 32 away from the switch actuated position to a set position as shown in FIG. 5A. Shaft 50 extends into housing B at opening 96 to support the left end of the shaft. To support the right end of shaft 50, a threaded bushing 104 having a collar **104*a* and a center bore 104*b* is positioned over the shaft. As shown in FIG. 4, bushing 104 extends through a customer partition 110, shown in phantom lines, and a dimple 112 aligned with an opening 114 in the partition orients timer A. Dial D is then positioned over bushing 104 which extends through another opening in partition 110 and nut 106 is threaded onto the bushing. This arrangement mounts timer A onto partition 110. Since bushing 104 extends through an opening 116 in housing B, the housing and bushing supports the right end of shaft 50 preparatory to the timer being mounted onto partition 110. In this manner, the internal operating mechanism of timer A is assembled for transit and bushing 104 extends from housing B to allow partition mounting by nut 106**.

Figure 8:
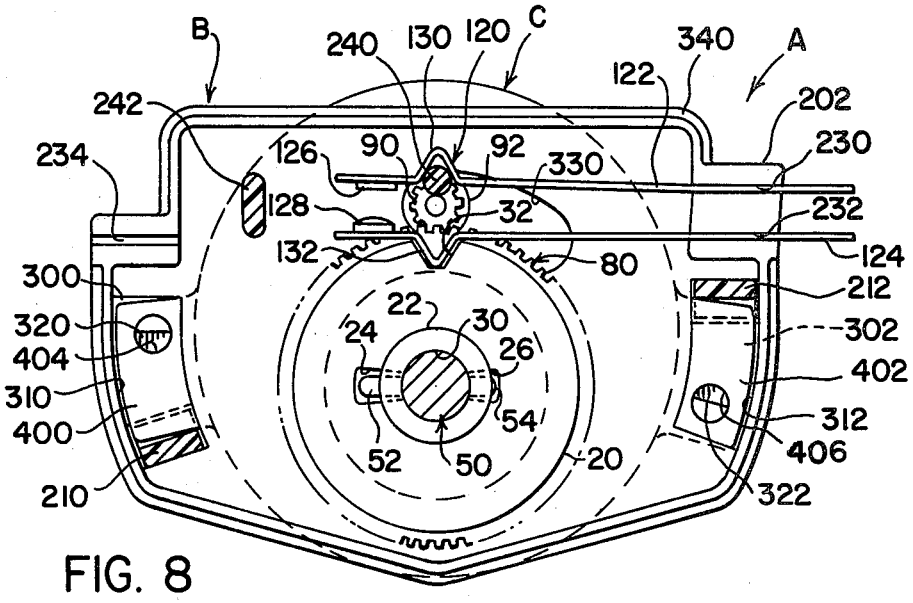
FIG. 8 is a cross-sectional view taken generally along line 8—8 of FIG. 4.

Within housing B there is provided a switch means 120 illustrated as a normally open switch. The switch means, in accordance with one aspect of the invention, includes conductive spring strips 122, 124 having electrical contacts 126, 128, respectively. These contact strips are releasably mounted within and on housing B. Matching protrusions 130, 132 control movement of the contacts. As shown in FIG. 8, protrusion 132 is adapted to drop into recess 32 of cam 20 when the cam is in the switch actuated position. This same concept is shown in FIG. 5B.

Figure 5B:
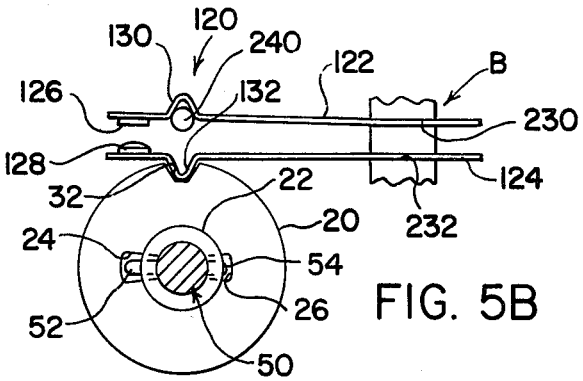

Referring now to FIGS. 5A, 5B, when knob E rotates shaft 50 in a counter-clockwise direction, recess 32 is spaced from downwardly extending protrusion 132 of strip 124 to close contacts 126, 128. This is the closed position for the normally open contacts. As motor C is energized to start the timing cycle, protrusions 52, 54 carried by shaft 50 engage the walls of recesses 24, 26 as shown in FIG. 5A. This action drives cam 20 to a position generally shown in FIG. 5B. At that time, protruding portion 132 drops into recess 32 moving recesses 24, 26 ahead with respect to protrusions 52, 54. Motor C is then deenergized and the timing cycle has been completed. To reset timer A, knob E again rotates shaft 50 to a position generally shown in FIG. 5A. To start the timing cycle, motor C is energized and a timing cycle is repeated. Spring strips 122, 124 are mounted directly in housing B. They are not part of a separate commercially available switch unit of the type generally used in the prior art timers. When describing the components of housing B, the manner by which strips 122, 124 are supported on housing B itself will become apparent.

Figure 1:
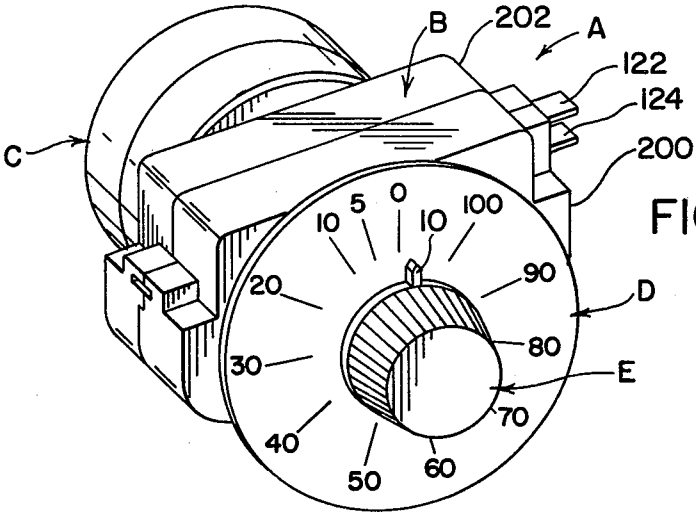
FIG. 1 is a pictoral view showing the preferred embodiment of the present invention.
Figure 2:
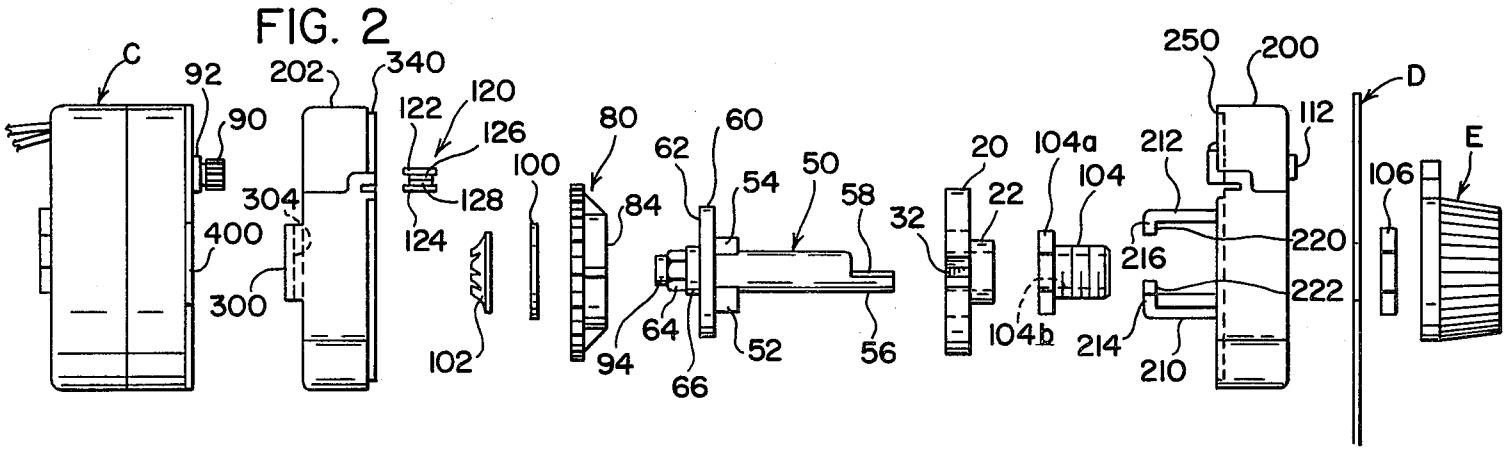
FIG. 2 is an exploded view illustrating the various components which are assembled together to produce a hand set timer constructed in accordance with the present invention.
Figure 6:
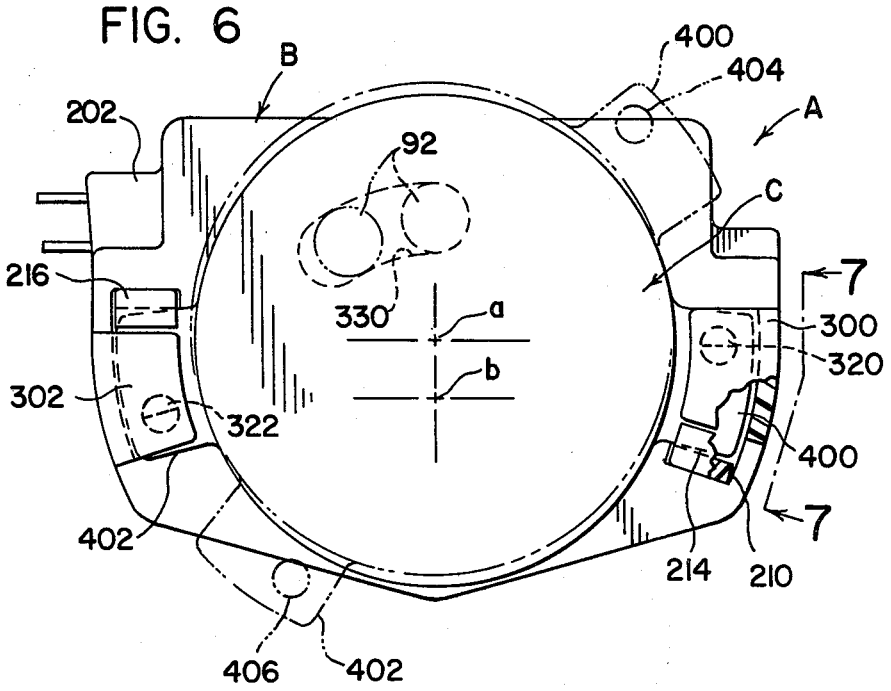
FIG. 6 is a back plan view of the preferred embodiment of the present invention showing the timer in its assembled position and the motor in a phantom line position preparatory to assembly.
Figure 7:
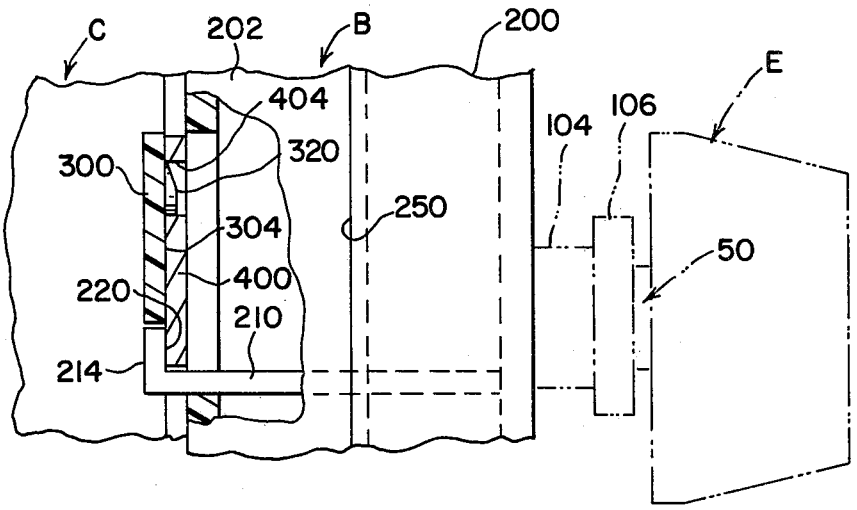
FIG. 7 is a enlarged, partial cross-section view taken generally along line 7—7 of FIG. 6.
Figure 9:
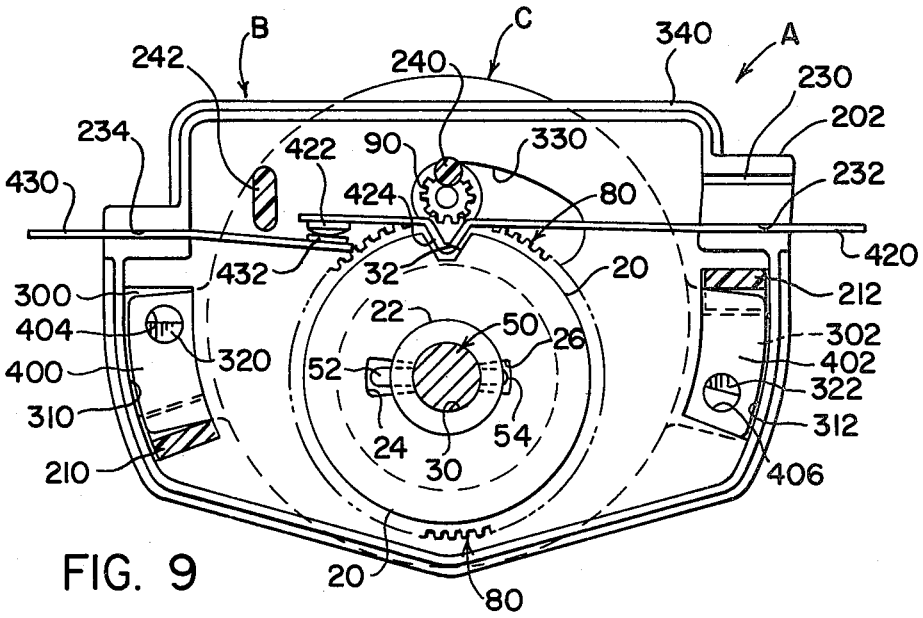
FIG. 9 is a view similar to FIG. 8 showing a normally closed contact arrangement for the timer.
Figure 10:
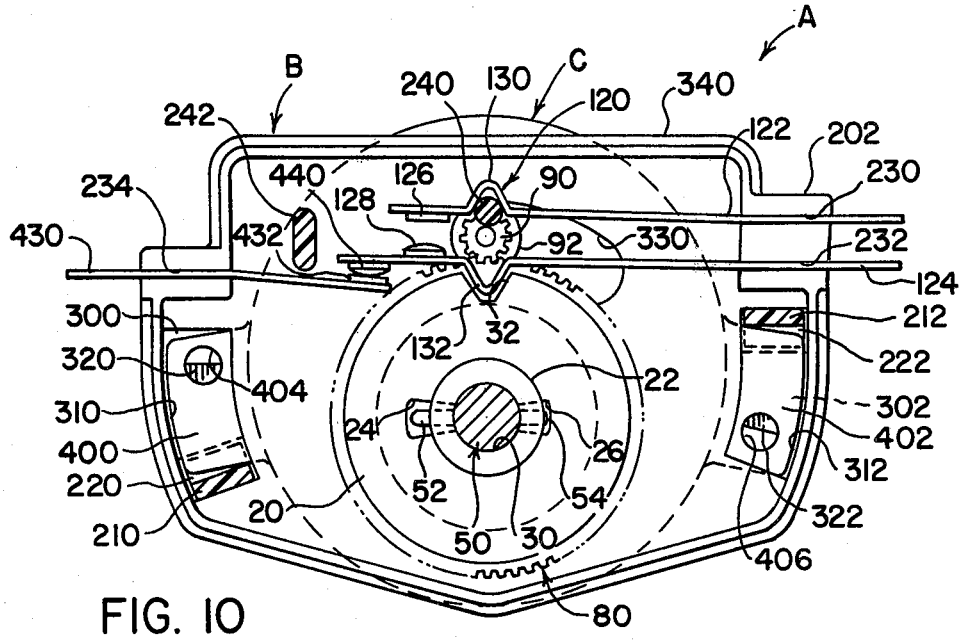
FIG. 10 is a view similar to FIGS. 8 and 9 illustrating still a further contact arrangement wherein a double throw-output switch is employed; and, FIG. 11 is a cross-sectional view taken generally along line 11—11 of FIG. 4.
Figure 11:
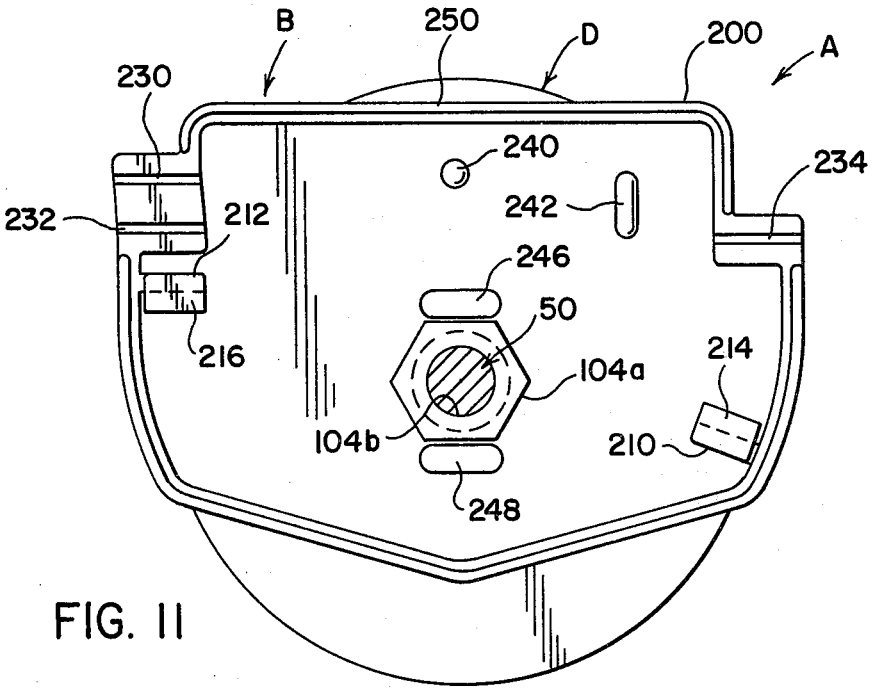

In accordance with the present invention, housing B is formed of two complementary components held together by motor C in a manner which is best illustrated by referring to FIGS. 3, 6 and 7. Housing B includes a cover 200 and matching base 202 which may be of tray-shaped from having generally the same contour shapes. Each component forms one-half of housing B. Referring more particularly to cover 200, two integral lock arms 210, 212 extend rearward from cover 200 in a direction opposite to the forwardly facing outer surface where knob E is mounted. Each of these locking arms includes a nose, i.e. 214, 216, which noses include inwardly facing shoulders 220, 222, respectively. Switch blade or strip mounting slots 230, 232 and 234 are formed partially in cover 200 and partially in base 202 so that when these two components are assembled, as shown in FIGS. 1 and 4, slots 230, 232 and 234 will receive and hold individual switch blades or strips. Three separate slots are illustrated for selectively receiving switch strips. As will be apparent later, as shown in FIGS. 8–10, different slots may be employed to produce different switching functions. Of course, other slots for releasably securing switch strips or blades could be molded into housing B. Although it is preferred that these slots be formed jointly in cover 200 and base 202, it is conceivable that the slots could be formed in either one of these two components which are clamped together by motor C in accordance with an aspect of the invention. Switch control pin 240 extends inwardly from the bottom of cover 200, as best shown in FIG. 3. This pin engages protrusion 130, as shown in FIGS. 8 and 10, to limit the lowest possible position of blade 122. This concept is shown schematically in FIG. 5B. When lower strip 124, which is biased downwardly, shifts into the position with protruding portion 132 in recess 32, normally open contacts 126, 128 are opened. A switch control abutment 242 also extends from bottom wall of cover 200 and extends toward and into base 202. This switch control abutment is not used in switching arrangements shown in FIGS. 5A, 5B or 8; however, it is employed in the switching arrangement as shown in FIGS. 9 and 10, for a purpose to be described later. Bushing stabilizing tabs 246, 248 are adapted to coact with the hexagonal head or collar **104*a* of bushing 104 so that the bushing will not rotate with respect to cover 200. Consequently, the bushing can be used to assemble timer A onto partition 110. Around the periphery of cover 200 there is provided an interlocking edge 250 which coacts with a similar edge 340 on base 202** so that the two housing components can be interlocked in proper oriented position along their irregular contoured peripheral edges.

Referring now to base 202, this base includes spaced locking tabs or ears 300, 302 having inwardly facing shoulders 304, 306, respectively. These shoulders overlap openings 310, 312, respectively, at the rearwardly facing outer surface of base 202 onto which motor C is mounted. These tabs or ears are at the same location as noses 214, 216 which extend through openings 310, 312, respectively. Shoulders 220, 222 are coplanar with shoulders 304, 306, as best shown in FIG. 7. To allow clearance for noses 214, 216, openings 310, 312 are larger than tabs 300, 302. For a purpose to be described later, shoulders 304, 306 are provided with detent lugs or dimples 320, 322, respectively. As arcuate clearance opening 330 is provided in the rear wall of base 202 to accept pinion gear 90 and its surrounding boss 92. This opening is arcuate and has a center corresponding generally to the center of shaft 50 which is at axis b, shown in FIG. 6. In practice, axis b is the axis of shaft 50 which extends through housing B. Base 202 has an interlocking peripheral edge 340 that matches edge 250 on cover 200. In this manner, cover 200 and base 202 are interlocked and snapped together. These two components are formed from a plastic material, which in practice is polycarbonate.

To assemble timer A the internal components are assembled as previously described. Arms 210, 212 are directed through openings 310, 312 so that the inwardly facing shoulders 220, 222 and 304, 306 are aligned when cover 200 and base 202 are assembled. This relationship is shown generally in phantom line position of FIG. 6. Motor C includes standard outward extending tabs or flange portions 400, 402, each of which has a standard screw hole 404, 406, respectively. Tabs or flange portions 400, 402 are rotated from the phantom line position in FIG. 6 to the solid line position for the motor and the flange portion. Arms 210, 212 form stops for the rotational bayonet type locking movement of the flange portions under locking tabs 300, 302 to axially lock motor C and housing components 200,202 together. Standard screw holes 404, 406 interact with detents or dimples 320, 322 to lock the flange portions into the solid line position shown in FIG. 6. This action locks cover 200 and base 202. Thus, by merely rotating motor C into the locking position, timer A is held together. Detents 320, 322 have inclined leading portions, as shown in FIG. 7. This allows rotation of motor C into the assembled position, flange portions 400,402 riding up and over detents 320,322 and springing locking tabs 300,302 outwardly until the detents snap into screw holes 404,406 in flange portions 400,402. Motor C thus is snap locked in proper oriented position with both housing components 200,202 which are themselves locked by their interlocked peripheral edges 250,340 in proper oriented position. Disassembly requires specific attention and cannot be done inadvertently under normal operating conditions.

Referring now generally to FIG. 8, switch means 120 is a normally open switch. When switch 12 is in the switch actuated position, as shown in FIG. 5B, lower spring strip 124 is biased downwardly into recess 32. This opens normally open contacts 126, 128.

Referring now to FIG. 9, a normally closed switch means is formed from a spring strip 420 similar to strip 124 in FIG. 8. This spring strip has a contact 422 and a downwardly protruding portion 424, which is forced downwardly into recess 32 when cam 20 is in the switch actuated position. When this condition occurs, contact 422 engages contact 432 of generally fixed conductive strip 430 held in slot 234. In the manually set position strip 430 is limited in upward travel by abutment 242 and contacts 422, 432 are separated. Thus, FIG. 9 shows a normally closed switching arrangement using two strips, one of which is mounted in slot 232 and the other of which is mounted in slot 234. Of course, these slots include an arrangement for fixedly securing the conductive strips in place.

Referring now to FIG. 10, a single pole, double throw switch is constructed by using a modification of switch means 120 and strip 430. An additional contact 440 is assembled onto the lower portion of strip 124. This contact coacts with contact 432, as explained in connection with FIG. 9. When cam 20 is moved into the hand set position, contacts 126, 128 are closed and contacts 432, 440 are opened. When motor C is energized and cam 20 is moved to the switch actuated position, as shown in FIG. 10, the contact states are reversed. Contacts 126, 128 are opened and contacts 432, 440 are closed. Various other arrangements could be used for mounting conductive strips within housing B to define switching functions for timer A without using standard, purchased switch units.

Having thus defined the invention, the following is claimed:

1. In a hand set timer including a housing, means for mounting a constant speed motor onto said housing, said motor having a driven output shaft, a drive shaft supported for rotation in said housing, a switch actuating element in said housing and driven by said drive shaft between a manual set position and a switch actuated position, means connecting said output shaft to said drive shaft for driving said switch actuating element in a first direction by said motor from said set position to said switch actuated position, manual means connected to said drive shaft for moving said switch actuating element, independently of said motor, in a second direction between said actuated position and said set position, the improvement comprising: said housing including first and second complementary housing components, said first component having a first outer surface facing outwardly and forwardly in a direction axially of said drive shaft, said second component having a second outer surface facing outwardly and rearwardly from said housing in a direction axially of said drive shaft, said first and second housing components having interlocking peripheral edges, and locking means comprising cooperating locking shoulder means respectively affixed to said motor and to said first housing component and engaged with one another for locking said housing components axially together and locking said motor onto said housing at said second surface.

2. The improvement as defined in claim 1 further including an elongated locking bar fixedly secured to said first component and extending to a location adjacent said second surface of said second component, said bar having a terminal nose with a first locking shoulder facing said first component, a lock tab on said second component and having a second locking shoulder at said location and facing said first component; and said locking means affixed to said motor includes a flange element on said motor and movable into a locking position between said two shoulders and said second surface whereby said first and second components are locked together.

3. The improvement as defined in claim 2 including a detent means for holding said flange element in said locking position.

4. The improvement as defined in claim 3 including a switch formed from two contacts with two relative contact states, each contact being supported on an elongated electrically conductive strip, and means on said housing for individually supporting each of said strips in cantilever fashion with at least one of said strips being movable to change the relative contact states of said contacts in response to said switch actuating element reaching said switch actuated position.

5. The improvement as defined in claim 2 including a switch formed from two contacts with two relative contact states, each contact being supported on an elongated electrically conductive strip, and means on said housing for individually supporting each of said strips in cantilever fashion with at least one of said strips being movable to change the relative contact states of said contacts in response to said switch actuating element reaching said switch actuated position.

6. The improvement as defined in claim 1 including a switch formed from two contacts with two relative contact states, each contact being supported on an elongated electrically conductive strip, and means on said housing for individually supporting each of said strips in cantilever fashion with at least one of said strips being movable to change the relative contact states of said contacts in response to said switch actuating element reaching said switch actuated position.

7. The improvement as defined in claim 6 wherein at least one of said strips is a spring carrying one of said contacts.

8. The improvement as defined in claim 7 wherein one of said housing components includes a fixed element against which one of said strips abuts at least when said contacts are in one of said two relative contact states.

9. The improvement as defined in claim 6 wherein one of said housing components includes a fixed element against which one of said strips abuts at least when said contacts are in one of said two relative contact states.

10. The improvement as defined in claim 9 wherein one of said strips is biased toward said switch actuating element and includes a deformed, protruding portion and said switch actuating element is a rotatable cam having a cam lobe with a contour generally matching said protruding portion of said one strip when said switch actuating element is in said switch actuated position.

11. The improvement as defined in claim 10 wherein said deformed portion protrudes toward said actuating element and said cam lobe is a recess at said switch actuated position.

12. The improvement as defined in claim 4 wherein one of said strips is biased toward said switch actuating element and includes a deformed, protruding portion and said switch actuating element is a rotatable cam having a cam lobe with a contour generally matching said protruding portion of said one strip when said switch actuating element is in said switch actuated position.

13. The improvement as defined in claim 12 wherein said deformed portion protrudes toward said actuating element and said cam lobe is a recess at said switch actuated position.

14. The improvement as defined in claim 1 wherein the said cooperating locking shoulder means form a bayonet type said locking means.

15. The improvement as defined in claim 1 wherein the said cooperating locking shoulder means are affixed on said motor and on both said first and second housing components.

16. The improvement as defined in claim 15 including a detent on the said locking shoulder means on said second housing component engaged within a recess in the said locking shoulder means on said motor to lock the said motor in predetermined oriented position on said housing.

17. The improvement as defined in claim 16 wherein the said cooperating locking shoulder means form a bayonet type said locking means.

18. The improvement as defined in claim 16 wherein the said locking shoulder means on said motor includes a flange element thereon provided with said recess and movable between said second outer surface and said locking shoulder means on both said housing components and springable over the said detent to snap lock said detent into said recess and lock the said motor in said oriented position on said housing.

19. The improvement as defined in claim 18 wherein the said cooperating locking shoulder means form a bayonet type said locking means.

20. The improvement as defined in claim 15 wherein the said cooperating locking shoulder means includes respective pairs of said shoulder means located on said first and second housing components at opposite lateral sides thereof and facing toward but spaced from said second outer surface on said second housing component, the locking shoulder means of each said pair thereof being coplanar and the said locking shoulder means on said motor comprising a pair of flange elements located at corresponding opposite lateral sides thereof.

21. The improvement as defined in claim 20 wherein each of the said locking shoulder means on said second housing component includes a detent thereon, and each of said flange elements is provided with a recess within which a respective one of said detents is engaged, said flange elements being movable between said second outer surface and respective said pairs of said locking shoulder means on said first and second housing components and being springable over the said detents to snap lock them into the said recesses in the flange elements and lock the said motor in predetermined oriented position on said housing.

* * * * *